United States Patent [19]

Sahi

[11] Patent Number: 5,002,189

[45] Date of Patent: Mar. 26, 1991

[54] DISPOSABLE ONE-TIME USE PACKAGE OF MOUTHWASH

[76] Inventor: Khalid I. Sahi, 4100 Marine Dr., Chicago, Ill. 60613

[21] Appl. No.: 510,064

[22] Filed: Apr. 17, 1990

[51] Int. Cl.[5] ..... B65D 17/00

[52] U.S. Cl. ..... 206/633; 132/333; 426/112

[58] Field of Search ..... 132/333; 206/63.5, 83, 206/438, 484, 581, 362.2, 362.3, 69, 620, 633, 634, 823; 220/359; 424/49; 426/112, 123

[56] References Cited

U.S. PATENT DOCUMENTS

| | | | |
|---|---|---|---|
| 2,898,003 | 8/1959 | Wilson et al. | 426/123 |
| 3,514,029 | 5/1970 | Powell | 426/123 |
| 4,280,653 | 7/1981 | Elias | 220/359 |
| 4,312,889 | 1/1982 | Melsheimer | 424/49 |
| 4,378,069 | 3/1983 | Franco | 206/620 |
| 4,884,688 | 12/1989 | Hurst | 206/362.2 |
| 4,925,033 | 5/1990 | Stoner | 206/69 |

FOREIGN PATENT DOCUMENTS

| | | | |
|---|---|---|---|
| 0613023 | 1/1961 | Canada | 206/438 |

*Primary Examiner*—Jimmy G. Foster

*Attorney, Agent, or Firm*—Lockwood, Alex, FitzGibbon & Cummings

[57] ABSTRACT

A one-time use package of mouthwash comprising a disposable container in the form of an open top cup containing a single portion quantity of mouthwash for use full strength as an oral rinse followed by disposal of cup and contents. The top opening of the cup is hermetically sealed by disc which preferably includes a pull-tab for facilitating its removal. The mouthwash contents contain an appreciable concentration of alcohol in aqueous solution and the cup and disc seal are formed of materials compatible with the contents. After emptying its content of mouthwash, the cup may be filled with water for a follow-up rinse with water if desired.

7 Claims, 1 Drawing Sheet

DISPOSABLE ONE-TIME USE PACKAGE OF MOUTHWASH

This invention relates generally to a disposable one-time use package of mouthwash of the type provided gratis for hotel and motel guests and the restrooms of club houses restaurants, hospitals, dental offices, airplanes, trains and the like. Such disposable one-time use packages of mouthwash are also suitable for inclusion in travel kits, handbags, brief cases, desk drawers, etc.

More particularly, the invention relates to disposable one-time or single use packages of mouthwash comprising small cup containing a single portion quantity (e.g. 5-25 milliliters) of mouthwash for use full strength as an oral rinse followed by disposal of the cup and contents. The cup and its contents are hermetically sealed by a closure disc adhered to the rim of the container and preferably provided with a pull tab to facilitate opening of the package and removal of the closure.

The object of the invention, generally stated, is the provision of an inexpensive sanitary disposable one-time use package of mouthwash suitable for us at various times and in various places where persons want or need an oral rinse without having access to a multi-portion supply. After the contents of mouthwash have been consumed, the containers may be used for filling with water when a follow-up rinse with water is desired.

Disposable one-time use packages of mouthwash have been known and available which are relatively expensive and the containers of which are generally not suitable for filling with water or follow-up usage.

For a more complete understanding of the nature and scope of the invention, reference may now be had to the following description of a preferred embodiment thereof taken in connection with the accompanying drawings wherein.

Figure 2:
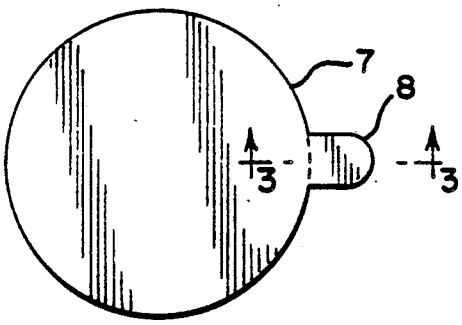
FIG. 2 is a top plan view of the package shown in FIG. 1.
Figure 3:
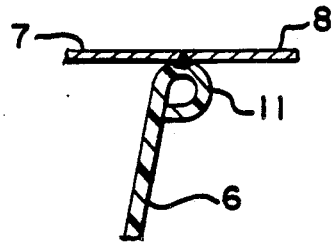
FIG. 3 is a fragmentary sectional view on enlarged scale taken on line 3—3 of FIG. 2.
Figure 1:
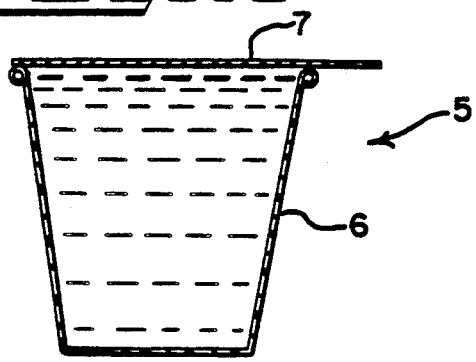
FIG. 1 is a vertical sectional view through a disposable one-time use package of mouthwash embodying the invention.

In FIG. 1, a package of mouthwash is indicated generally at 5 comprising a frusto-conically shaped container 6 hermetically sealed by a closure disc 7 which has an integrally attached pull tab 8 to facilitate removal of the closure and opening of the package. Typically, the container cup 6 and closure 7 are formed of materials that are resistant to mouthwash contents generally including an appreciable concentration of alcohol and various other ingredients such as glycerine, detergents, flavors, preservatives, germicides, dyes etc. The cup 6 may be thermo-formed or injection molded from various known food grade plastics resistant to aqueous alcohol solutions such as known grades of polyethylene terephthalate (PET) or aromatic polycarbonates (Lexan). The closure disc 7 can be suitably from a laminate including an exposed ply of paper laminated to a concealed ply of aluminum foil or an alcohol compatible plastic coating. Preferably, the mouth or rim of the container 6 has a rolled rim 11 so as to present a smooth surface to the lips of the user. The closure disc 7 may be hermetically sealed to the rim 11 by various known techniques including adhesives, thermo-sealing, or ultra-sonic sealing.

It will be understood that the size of the cup 6 will vary depending upon the size or quantity of the mouthwash contents. Typically, the contents will range from 5 to 25 milliliters in volume. The cost of the package 5 will be sufficiently low so that if desired, two or more of the packages can be used.

For ease in handling, because of their relatively small size, the packages 5 may conveniently be loaded in inexpensive disposable plastic trays, one or more layers deep, with the tray being provided with a cover or overwrap.

What is claimed is:

1. A one-time package of mouthwash comprising, a disposable cup, a single portion quantity of mouthwash sealed in said cup for full strength use in an amount suitable for a one-time oral rinsing followed by disposal of container and contents, and a tamper-resistant non-reusable closure disc hermetically sealed to the rim of the cup, said mouthwash containing an appreciable concentration of an alcohol in an aqueous solution, and said cup and said seal being formed of food-grade materials resistant to and compatible with said mouthwash contents.

2. The package of mouthwash called for in claim 1 wherein the quantity of said mouthwash is in the range of from about 5 to 25 milliliters.

3. The package of mouthwash called for in claim 1 wherein said cup container is formed of plastic.

4. The package of mouthwash called for in claim 1 wherein said closure disc is a laminate adhesively secured to the mouth of said cup container.

5. The package of mouthwash called for in claim 1 wherein said closure disc is a laminate heat sealed to the mouth of said container cup.

6. The package of mouthwash called for in claims 4 and 5 wherein said laminate disc closure has a pull tab for use by the consumer to initiate opening of said package.

7. The package of mouthwash called for in claim 1 wherein said cup has a smooth rolled rim.

* * * * *